US005538076A

United States Patent [19]

Nishida et al.

[11] Patent Number: 5,538,076

[45] Date of Patent: Jul. 23, 1996

[54] PIPE FITTING MECHANISM AND HEAT EXCHANGER USING SAME

[75] Inventors: Terumi Nishida, Nukata-gun; Shozo Kato, Toyoake; Mituru Kimata, Nishikasugai-gun, all of Japan; Takashi Fujimoto, Victoria, Australia

[73] Assignee: Nippondenso Co., Ltd., Kariya, Japan

[21] Appl. No.: 358,087

[22] Filed: Dec. 15, 1994

[30] Foreign Application Priority Data

Dec. 17, 1993 [JP] Japan ..... 5-317967

[51] Int. Cl.[6] ..... F28F 9/02; F16L 41/08

[52] U.S. Cl. ..... 165/76; 165/178; 285/319; 285/189

[58] Field of Search ..... 165/76, 178; 285/189, 285/319, 921

[56] References Cited

U.S. PATENT DOCUMENTS 4,773,474 9/1988 Stay ..... 165/76
4,887,666 12/1989 Briet ..... 165/76
4,887,849 12/1989 Briet ..... 285/91

FOREIGN PATENT DOCUMENTS 61-157796 9/1986 Japan .
62-85791 6/1987 Japan .
4359796 12/1992 Japan .
2082749 3/1982 United Kingdom ..... 165/178

*Primary Examiner*—Allen J. Flanigan
*Attorney, Agent, or Firm*—Cushman, Darby & Cushman

[57] ABSTRACT

Projections are formed on the tip end part of a pipe for directly fitting the pipe into a capsule without using any extraneous elements, thus providing an economical and firmly fitting mechanism. Such a structure is commonly used in a heat exchanger. A tank includes a capsule formed into a box shape with one side open and a bottom panel disposed at the upper and lower ends of a heat exchanger and brazed thereto. A pipe fitting hole is formed in a side panel of the capsule, and around the pipe fitting hole is concavely formed a ring-shaped part inside the tank, and around the-ring-shaped part is formed a cylindrical part approximately at a right angle to the plane of ring-shaped part. On pipe is formed a flange part, and on a tip end part of the pipe are formed projections. The pipe is fit to the capsule of the tank by caulking an annular sealing material to the outer periphery of an end part of the pipe, fitting the end part into the pipe fitting hole, and contracting the annular sealing material between the ring-shaped part, the cylindrical part and the flange part.

14 Claims, 12 Drawing Sheets

PIPE FITTING MECHANISM AND HEAT EXCHANGER USING SAME

CROSS REFERENCE TO RELATED APPLICATIONS

This application is based upon and claims priority from Japanese Application No. 5-317967 filed Dec. 17, 1993, the contents of which are hereby incorporated herein by reference.

BACKGROUND OF THE INVENTION

1. Field of the Invention

The present invention relates to the connection between a heat exchanger and external pipes. More particularly, the present invention relates to the connection between a panel material forming a heat exchanger and a tank and a pipe disposed for supplying or discharging a heat exchanging medium to or from the tank.

2. Related Art

A known heat exchanger, such as a heater core for vehicles, generally comprises a box-shaped capsule, i.e., a panel material, composed of side panels, i.e., panel surfaces, that extend at both sides of a top wall in the longitudinal direction thereof, and a bottom panel, i.e., a seat panel, for closing the opening part of the capsule in the upper and lower end positions or left and right end positions. In such a conventional heat exchanger, a plurality of heat exchanging tubes communicate with both tanks by having both end parts of the tubes connected to the bottom panels of both tanks, with heat exchanging fins being disposed between the heat exchanging tubes. In addition to the above arrangement, a pipe is fixed to a part of the side panel of the capsule for supplying or discharging a heat exchanging medium to or from the tank.

In the heater core for vehicles, the pipe for supplying or discharging the heat exchanging medium should be long enough to connect a rubber hose connected to the engine side to the tank. To directly fix the requisite long pipe to the capsule of the tank, a method is disclosed in Japanese Unexamined Patent Publication No. 4-359796. This method suggests connecting the long pipe to the tank by means of clamp as illustrated in FIGS. 10 and 11.

That is, tank 1 is composed of a capsule 2 and bottom panel 25 disposed in the upper and lower end positions respectively. Here, capsule 2 is made of a thin metal sheet and formed integrally with tank 1 so as to be a box with one side open. Bottom panel 25 is also made of a thin metal sheet. Bent part 26 bent upwards at a right angle with respect to bottom panel 25 along the edge thereof is fixed to capsule 2 by means such as brazing to form tank 1.

In the specified position of one of side panels 22 at capsule 2 of tank 1, such as one of the longitudinal end parts of tank 1, pipe fitting hole 3 is formed by press machining. Peripheral edge part 4*a* is formed around pipe fitting hole 3, and is concentric with pipe fitting hole 3 concurrently with the press machining of pipe fitting hole 3. Also concurrently with the press machining of pipe fitting hole 3, two circular concave parts are formed by press machining. The two circular concave parts are first flat part 6 concavely formed so as to constitute the annular plane towards the inside of tank 1 through the surface of side panel 22 and cylindrical part 5, and second flat part 8 concavely formed towards the inside of the tank 1 through first flat part 6 and second cylindrical part 7 in the radially inward position of first flat part 6 so as to constitute the annular plane which makes the inner peripheral edge of pipe fitting hole 3. As described above, cylindrical part 5 of first flat part 6 and second cylindrical part 7 of second flat part 8 constitute circles concentric with pipe fitting hole 3.

Pipe 10 is made of the same metal material as that of tank 1 and has approximately the same outside diameter as the inside diameter of pipe fitting hole 3. End part 11 is formed at one end of pipe 10, with end part 11 being fit into pipe fitting hole 3 and closely fitting the inner surface of peripheral part 4*a*. Flange part 12 is formed in a position connected to end part 11. Flange part 12 has dimensions set so as to lock with the inner peripheral surface of cylindrical part 5 of first flat part 6, the outside diameter of which being formed in side panel 22 of capsule 2.

Pipe 10 is fixed to capsule 2 of tank 1 by means of clamp 30, which is made of a highly elastic metal plate, such as a spring steel sheet, by bending the metal plate so as to be approximately U-shaped in the thickness direction so that end part 11 can be fit into pipe fitting hole 3 formed in side panel 22 of capsule 2 by caulking annular sealing material 18 to the outer periphery of end part 11, with annular sealing material 18 being trapped between second flat part 8 formed on side panel 22 of capsule 2, second cylindrical part 7 thereof and flange part 12.

By fixing pipe 10 to side panel 22 of capsule 2 of tank 1 of a heat exchanger by means of clamp 30, pipes having different bending angles according to the difference in vehicle model can be connected. However, as pipe 10 is fixed to side panel 22 of capsule 2 by means of only the elasticity of U-shaped clamp 30, the problem exists that the fixing strength is not sufficiently high. Another problem with this known fixing method is that use of clamp 30 requires extra cost and time for assembly. Yet another problem is that processing for forming cylindrical peripheral end part 4*a* for holding pipe 10 requires imparting a sufficient roundness to end part 4*a* and press machining to achieve this roundness is difficult.

SUMMARY OF THE INVENTION

In view of the above problems, it is an object of the present invention to provide a pipe fitting mechanism that allows a pipe to be connected to a side panel of a capsule making up a part of fluid equipment without requiring the use of any additional pieces, such as a clamp. Furthermore, the capsule should be formed in a shape which is easy for press machining, and the pipe and the capsule should be capable of being firmly fixed.

It is another object of the present invention to provide a heat exchanger which allows a pipe to be connected to a side panel of a capsule making up a tank of the heat exchanger, without requiring the use of any other elements, such as a clamp. Furthermore, the capsule should be formed in a shape which is easy for press machining, and the pipe and the capsule should be able to be firmly fixed to one another.

In order for the present invention to achieve the above objects, the present invention is directed to a fitting mechanism between a pipe and a panel material that includes a section of fluid equipment or a heat exchanger having a side wall or panel material and a pipe which is fixed to the panel material. The pipe fitting mechanism comprises a cylindrical part concavely formed on the surface of the panel material at approximately a right angle to the surface of the panel material. A ring-shaped part is formed on the inner peripheral side of a tip end part of the cylindrical part so as to be approximately parallel to the surface of the panel material, and a pipe fitting hole is formed at the central part of the ring-shaped part for fitting the pipe. The pipe includes a flange part that projects towards the outer peripheral side of the pipe and projections projecting to the outer peripheral side on the tip end of the side of the pipe to be inserted into the pipe fitting hole. The pipe and the panel material are locked to each other with contact occurring at the two interface portions existing between the projections and the ring-shaped part and between the flange part and the panel surface for preventing the displacement in the axial direction of the pipe. Furthermore, an annular sealing material is sandwiched between the outer peripheral part between the flange part and the projections of the pipe and the cylindrical part of the panel material.

According to the present invention, when a tip end of a pipe is fit into a pipe fitting hole formed in a side panel of a capsule forming part of a piece of fluid equipment, the pipe can be directly fixed to the panel material without using any other elements, such as a clamp, by fixing the pipe by means of the projections formed on the tip end of the pipe and the ring-shaped part formed on the panel surface of the panel material.

As a result, as material consumption can be reduced, cost can be reduced, and as the pipe can be fit by a single push-in action, the time required for pipe fitting can greatly be reduced.

Furthermore, in known fixing mechanisms, as the pipe is fixed to the panel surface of the panel material of the tank by means of a U-shaped clamp, the elasticity of the clamp deteriorates with age, and as a result, the fixing strength decreases. However, in the present invention, as the pipe is connected to the panel surface of the panel material by means of the projections, no problem such as deterioration in elasticity due to aging occurs, and the pipe and the panel material can be firmly fixed for a long time.

Furthermore, in the prior art, as the first flat part, the second flat part and the peripheral end part in contact with the pipe at the cylindrical surface are press machined concurrently with the press machining of the pipe fitting hole, the processing is difficult. Particularly, as a draft is required for a press die, it is difficult to achieve the required roundness of the peripheral end part which contacts the pipe at the cylindrical surface. However, according to the present invention, as the pipe is held (contacted) for the thickness of the panel material or less, there are excellent effects that press machining can easily be performed and the productivity of press machining can be improved, and to add, the manufacturing cost of press die can be reduced and the price of the product can be lowered accordingly.

Moreover, as the cylindrical peripheral end part is not provided and the flange part is not included in the panel material, the insertion length of the pipe into the tank, i.e., the distance from the panel surface of the panel material to the tip end part of the pipe, can be shortened. Therefore, the present invention allows elimination of a stagnant pool of fluid and the flow of fluid within the tank can be facilitated.

BRIEF DESCRIPTION OF THE DRAWINGS

Other objects, features, and characteristics of the present invention will be clear to those skilled in the art from study of the following detailed description, the appended claims, and drawings, all of which form a part of this application. In the drawings:

DETAILED DESCRIPTION OF THE PRESENTLY PREFERRED EXEMPLARY EMBODIMENT

Figure 1A:
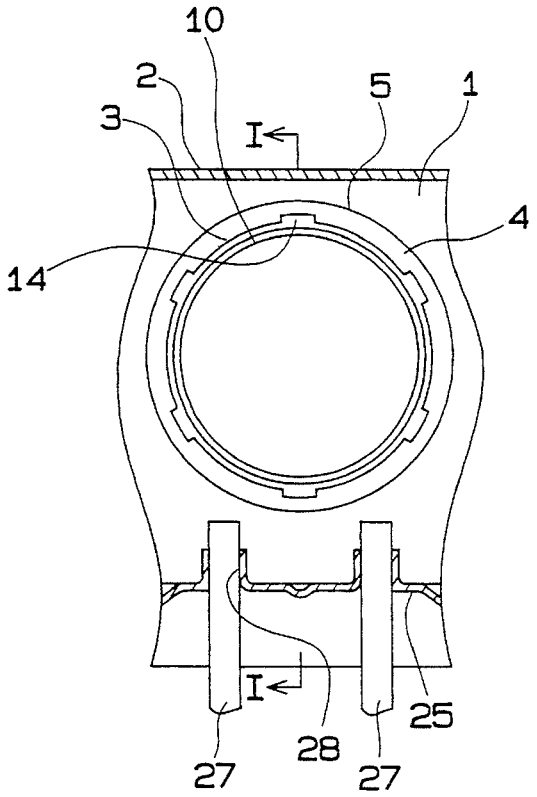
FIG. 1A is a cross-sectional view illustrating an important part of an embodiment of the heat exchanger according to the present invention.
Figure 1B:
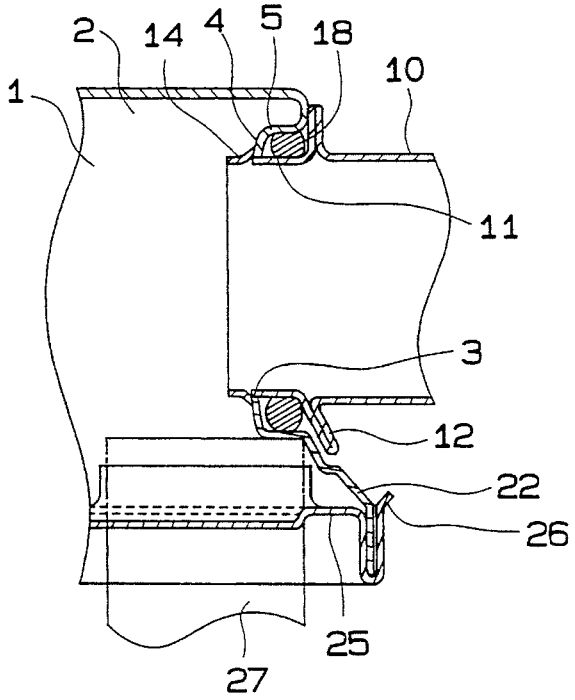
FIG. 1B is a cross-sectional view taken along the line I—I of FIG. 1A.
Figure 2:
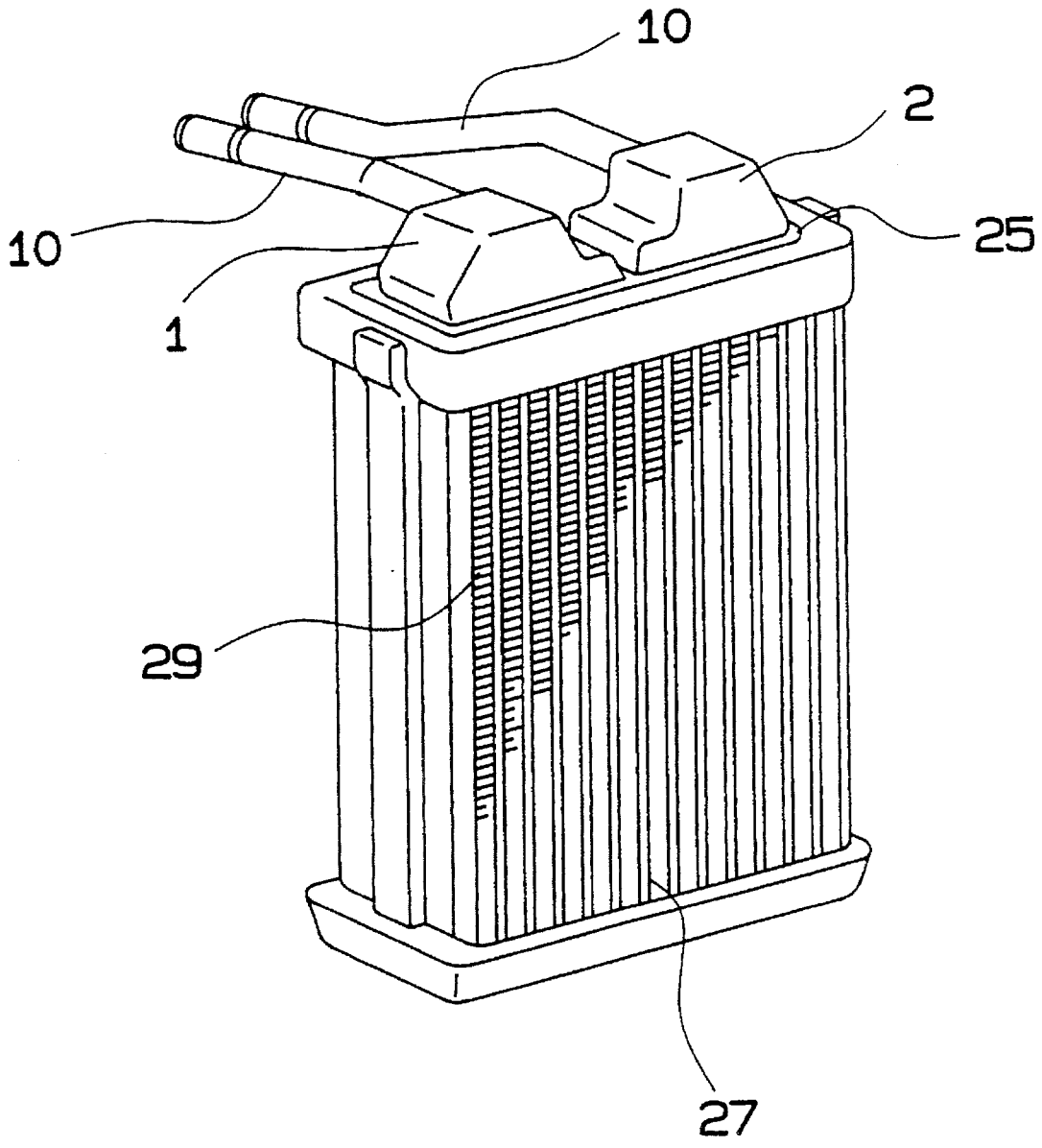
FIG. 2 is a perspective view illustrating a heat exchanger according to the present invention.
Figure 3A:
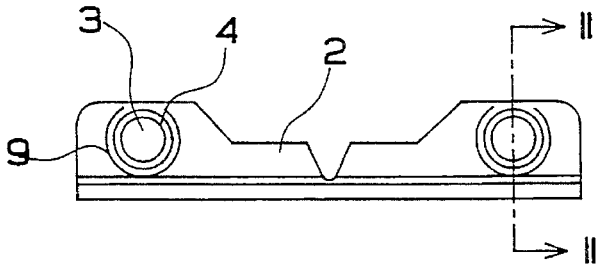
FIG. 3A is a schematic view illustrating a capsule according to the present invention.
Figure 3B:
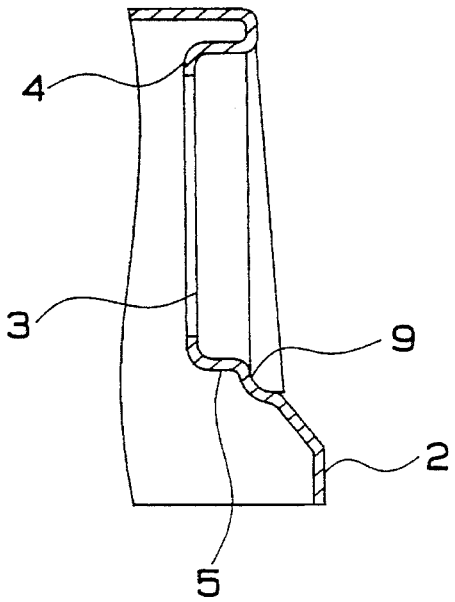
FIG. 3B is a cross-sectional view taken along the line II—II of FIG. 3A.
Figure 6B:
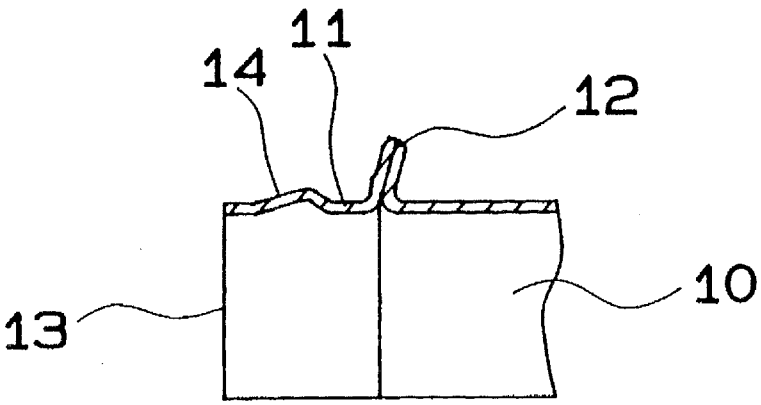
FIG. 6B is a partial cross-sectional view illustrating a side in FIG. 6A.
Figure 6A:
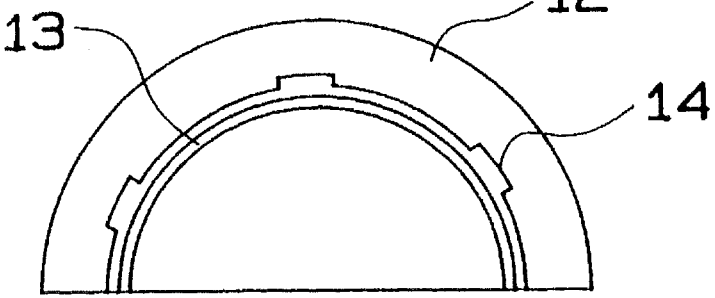
FIG. 6A is a partial side plan view illustrating a side of a pipe tip end according to the present invention.

A pipe fitting part, the first embodiment of the present invention, is illustrated in FIGS. 1A and 1B. The present invention may be applied to heat exchangers for vehicles. This heat exchanger is illustrated in FIG. 2, wherein the capsule of FIG. 2 is illustrated in FIG. 3A and 3B, and the pipe of FIG. 2 is illustrated in FIGS. 6A and 6B.

Tank 1 includes a capsule 2 and a bottom panel (seat panel) 25. Tank 1 is disposed in the upper end and lower end positions, with a piece thereof provided in each position, with the longitudinal direction thereof being horizontally positioned.

Capsule 2 is made of a thin metal sheet (e.g., brass, aluminum, stainless steel) and integrally formed into a box shape with one side opened which is framed by side panels, panel surfaces, 22 bent approximately at right angles from the longitudinal side edge of a top panel of tank 1 and an end panel connecting the connected to both top panel to the side panels 22 at both longitudinal ends of the top panel. Here, in this embodiment, a brass plate C2680R with a thickness of 0.5 to 0.8 mm is used for capsule 2.

Seat plate 25 is also made of a thin metal sheet, e.g., brass, aluminum, stainless steel. Bent part 26, which is bent upwards at a right angle along the overall peripheral edge of seat plate 25 is fixed to capsule 2 along the free end part of side panels and end panel of capsule 2 by means of brazing, welding or the like to form tank 1. Here, in this embodiment, a brass plate C2680R with a thickness of 0.45 mm is used for bottom plate 25.

A plurality of heat exchanging tubes 27 made of a thin metal sheet and formed to have flat cross-sectional shapes are fittingly inserted into insertion holes 28 formed to have the same cross-sectional shape as tubes 27 in bottom plate 25 of tank 1 and fixed to bottom plate 25 by means of brazing or the like. Between heat exchanging tubes 27 are fixed corrugated heat exchanging fins 29 made of a metal sheet by means of brazing them or the like to tubes 27. Here, in this embodiment, a brass plate C2680R with a thickness of 0.13 mm is used for tube 27, and a copper plate C1100RS with a thickness of 0.04 mm is used for fin 29.

In the specified position of one of side plates 22 of capsule 2 of tank 1, e.g., one of the longitudinal end parts of the tank 1, is formed pipe fitting hole 3 by press machining. Around pipe fitting hole 3 is formed ring-shaped part 4 concavely formed in press machining pipe fitting hole 3 in such a way that the annular plane can be formed inwards from the surface of tank 1. Ring-shaped part 4 is a circular concave member, which is concentric with pipe fitting hole 3. The outside of ring-shaped part 4 is chamfered for 0.2 mm to facilitate the insertion of pipe 10.

Around ring-shaped part 4 is cylindrical part 5 provided at approximately a right angle to the plane of the ring-shaped part 4. Flat part 9, as shown in FIGS. 3A and 3B is provided outside cylindrical part 5. Flat part 9 is approximately parallel to the plane of ring-shaped part 4 and serves as a contact surface with flange part 12 (described later) of pipe 10. Here, cylindrical part 5 and flat part 9 are circular and concentric with pipe fitting hole 3. Flat part 9 is inclined at approximately 3° to the side plate 22 so as to be parallel to ring-shaped part 4 and to ensure good contact with flange part 12 (described later). In this embodiment, flat part 9 is inclined at a right angle to the axial direction of tube 27 to facilitate the installation of pipe 10.

Pipe 10 is made of the same metal material, e.g., brass, aluminum, stainless steel, as that from which tank 1 is made. Furthermore, pipe 10 is formed to have approximately the same outside diameter as the inside diameter of pipe fitting hole 3. Flange part 12 is formed on pipe 10. On an end of the pipe 10 is formed end part 11, see FIG. 4, which is inserted in pipe fitting hole 3. On tip end part 13 formed at the tip end of end part 11 are chased projections 14 for locking pipe 10 to capsule 2. Projection 14 is disposed in six positions, see FIGS. 5A, 6A, and 7A, at regular intervals around the tip end part 13, and each projection 14 is approximately 2 mm in circumferential length and 0.35 mm in height. The surface of pipe 10 is tapered from tip end part 13 of pipe 10 to the peak of projection 14. The taper is at approximately 20° to the axial direction of pipe 10 indicated by axis i in FIG. 4. A line drawn from the peak of projection 14 to outermost part of flange part 12 tapers at approximately 80° to axial direction i of the pipe 10. Illustrated flange part 12 which has a larger outside diameter than the outside diameter of pipe 10 is formed integrally with pipe 10 and vertically projects from pipe 10. Furthermore, flange 12 need not be integral with pipe 10. Rather, flange 12 may be a separate piece formed as a circular body that may be welded to pipe 10.

The pipe 10 fits into capsule 2 by caulking annular sealing material 18 to the outer periphery of end part 11 and inserting end part 11 into pipe fitting hole 3 formed in the side plate 22 of the capsule 2 so that sealing material 18 can be contracted between flat part 4, cylindrical part 5, and flange part 12. This structure assures that the seal between pipe 10 and capsule 2 is water-tight.

As a result of fixing pipe 10 to capsule 2 without using any extra elements, the number of man-hours and the number of parts and components required for the soldering process can be reduced and therefore the price of the finished product can be reduced. Also, production can be facilitated in comparison with known structures for joining a pipe to a heat exchanger or the like, as in known structures, pipe 10 is soldered to the heater core, i.e., heat exchanger. Furthermore, post-production processes, such as a washing process, leakage inspection and packing after finishing the heater core, can easily be automatized. Moreover, in a conventional device where pipe 10 is soldered to the heater core, a large space is required in physical distribution, thus making it impossible to carry the assemblies in large quantities. According to the present invention, however, as pipe 10 is fixed to capsule 2 without using any further elements other than the parts described above, pipe 10 and capsule 2 can be carried separately and efficiently.

Next, the second embodiment of the present invention will be described.

As the second embodiment is a modification to the first embodiment only at capsule 2, description will be given only to the shape of capsule 2 and the fitting of capsule 2.

Capsule 2 is integrally formed using a thin metal sheet, e.g., brass, aluminum, stainless steel, which is shaped into a box shape with one side open framed by side panels bent approximately at right angles from the longitudinal side edge of a top panel of tank 1 to the top panel and an end panel connecting the top panel to the side panels at both longitudinal ends of the top panel. Here, in this embodiment, a brass plate C2680R with a thickness of 0.5 to 0.8 mm is used for capsule 2.

Figure 9A:
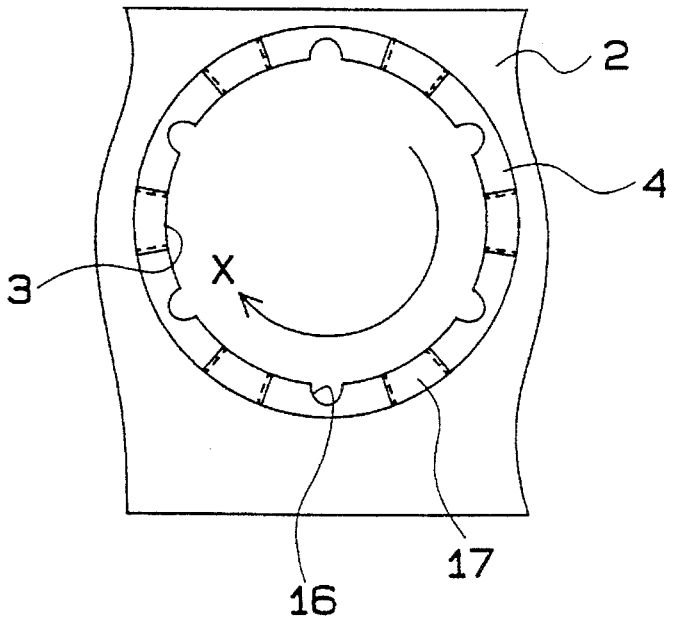
FIG. 9A is a fragmentary enlarged view illustrating a capsule according to the present invention.
Figure 9B:
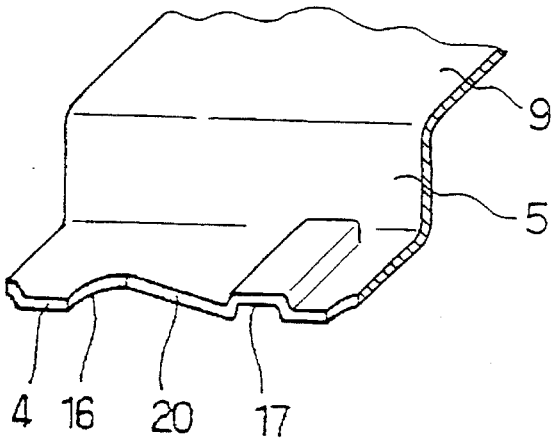
FIG. 9B is a perspective view in the direction of the arrow C in FIG. 9A.
Figure 10:
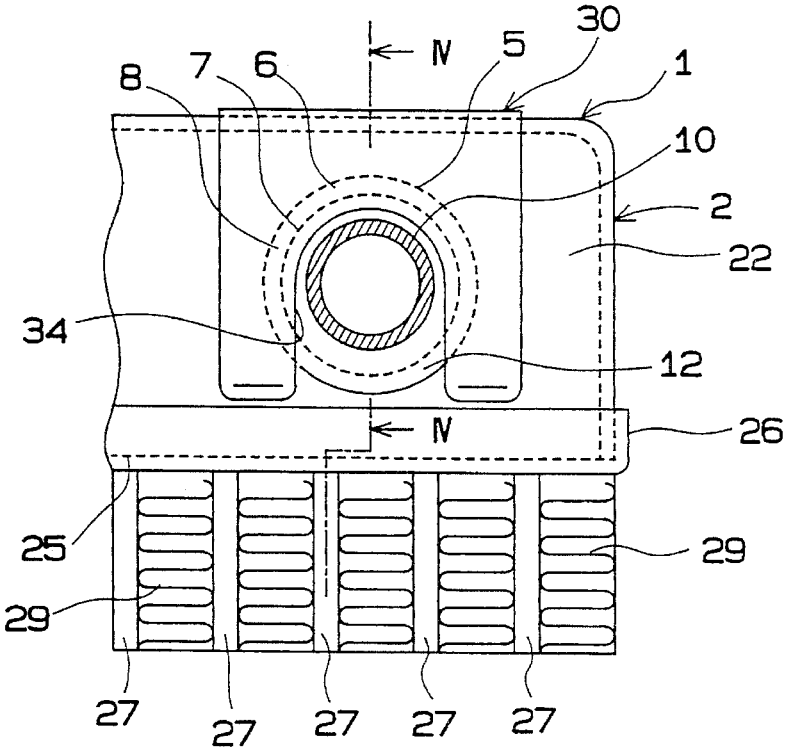
FIG. 10 PRIOR ART
FIG. 10 is a partial perspective view of a conventional heat exchanger.
Figure 11:
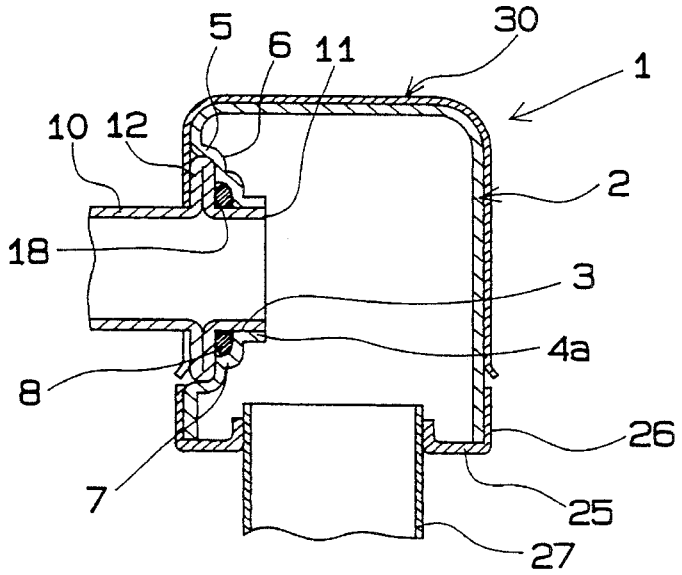
FIG. 11 PRIOR ART
FIG. 11 is a partial cross-sectional view taken along the line IV—IV in FIG. 10.

In the specified position of one of the side plates of capsule 2, e.g., one of the longitudinal end parts of the tank 1, a pipe fitting hole 3 is formed by press machining. Around pipe fitting hole 3 is formed ring-shaped part 4 concavely formed during press machining pipe fitting hole 3 in such a way that the annular plane is disposed in the direction of tank 1. Ring-shaped part 4 is circular and concave as well as concentric with pipe fitting hole 3. The outside of ring-shaped part 4, the side at which pipe 10 is inserted, is chamfered for 0.2 mm to facilitate the insertion of pipe 10. Ring-shaped part 4 includes notched part 16, FIGS. 9A and 9B, for facilitating the insertion of projections 14 formed on pipe 10, inclined part 20 for guiding inserted pipe 10, and level difference part 17 for holding (locking) projection 14. Here, level difference part 17 corresponds to the recessed holding part referred to in the claims.

Around ring-shaped part 4 is formed cylindrical part 5 provided at approximately right angles to the plane of ring-shaped part 4. At the outside of cylindrical part 5 is provided flat part 9 which is approximately parallel to the plane of ring-shaped part 4 and serves as a contact surface with flange part 12 of pipe 10. Here, cylindrical part 5 and flat part 9 are circular and concentric with pipe fitting hole 3. Flat part 9 is inclined at approximately 3° to side plate 22 so as to be parallel to ring-shaped part 4 and provide good contact with flange part 12. In this embodiment, flat part 9 is inclined at a right angle to the axial direction of tube 27 to facilitate the installation of pipe 10.

Now, the fitting of pipe 10 in capsule 2 will be described.

Projections 14 of pipe 10 are mated with notched parts 16 and then pipe 10 is inserted into capsule 2. Pipe 10 is then turned clockwise as indicated by arrow x in FIG. 9A. Projections 14 of pipe 10 are guided to level difference parts 17 along inclined part 20. Level difference parts 17 firmly fix pipe 10 into capsule 2 by playing a role of a locking mechanism. According to the present invention as described above, pipe 10 can be fitted into capsule 2 with little elastic deformation, and what is more, pipe 10 can be firmly fit to capsule 2.

Furthermore, several modifications to the above embodiments will now be described.

Pipe 10 may be fit to capsule 2 so as to be at substantially a right angle to the axial direction of tube 27 by providing a chased part (flat part 9) on side panel 22 of the capsule 2. This arrangement can facilitate the simplification or automatization of the process for fitting the pipe 10 to the heat exchanger. Furthermore, as this arrangement can secure the dimensional tolerances at two interfaces, one of which being between end part 11 behind projection 14 and pipe fitting hole 3 and the other of which being between flange part 12 and side panel 22, pipe 10 can be firmly fit into capsule 2.

A slit may be formed in several positions at regular intervals around ring-shaped part 4 to improve the flexibility of ring-shaped part 4 in the direction of insertion of pipe 10, thus facilitating insertion. Furthermore, it is also possible that a rib is formed in several positions at regular intervals around ring-shaped part 4 to improve the strength (rigidity) of ring-shaped part 4 for higher durability against vibration, pressure, etc. after insertion of pipe 10.

Figure 5B:
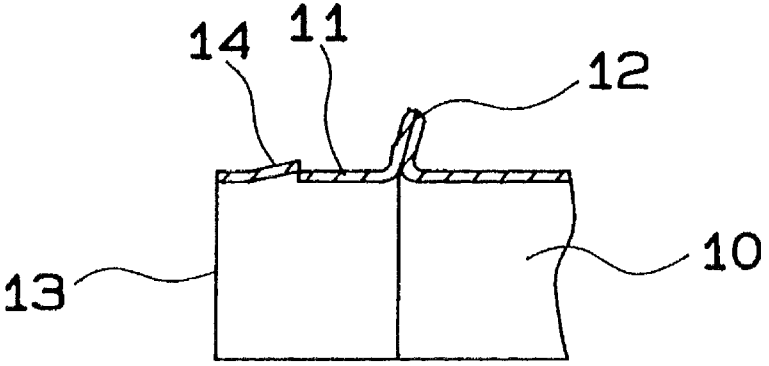
FIG. 5B is a partial cross-sectional view illustrating a side in FIG. 5A.
Figure 5A:
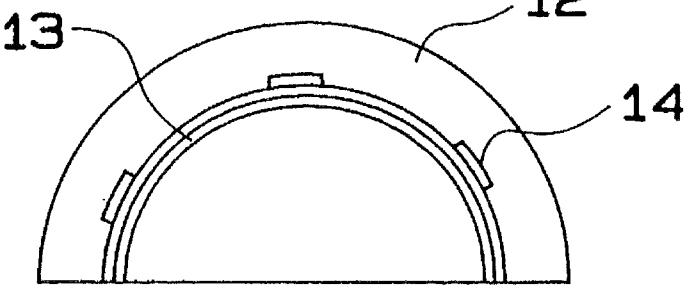
FIG. 5A is a partial side plan view illustrating a side of a pipe tip end according to the present invention.
Figure 7B:
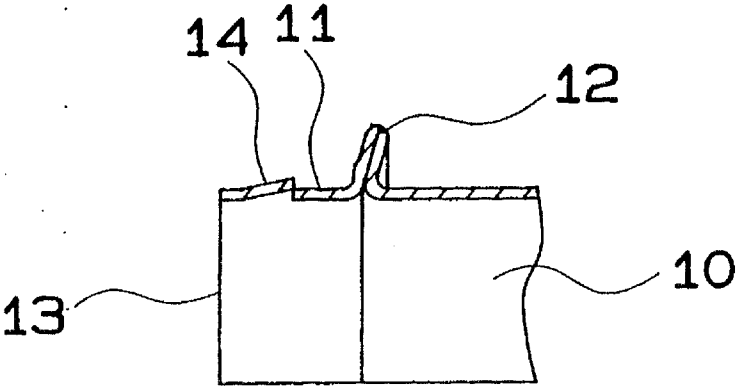
FIG. 7B is a partial cross-sectional view illustrating a side in FIG. 7A.
Figure 7A:
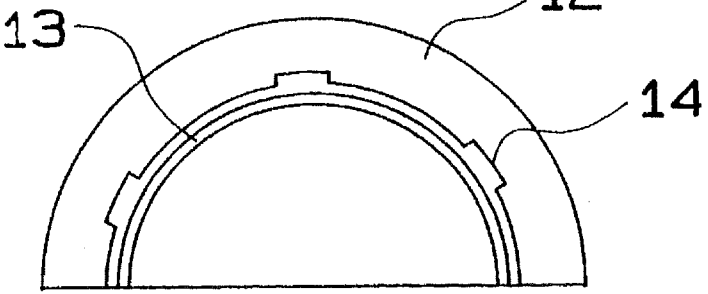
FIG. 7A is a partial side plan view illustrating a side of a pipe tip end according to the present invention.
Figure 12A:
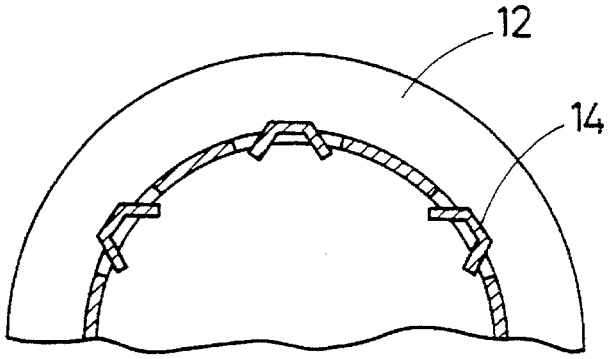
FIG. 12A is a partial side plan view illustrating a side of a pipe tip end according to the modified embodiment.
Figure 12B:
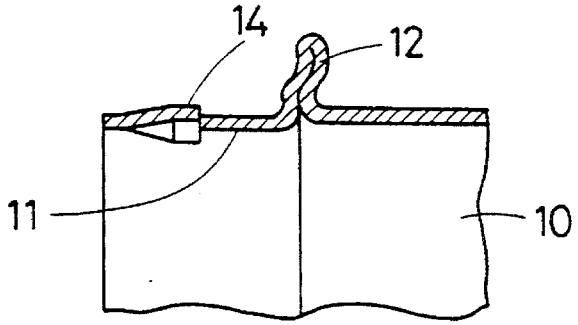
FIG. 12B is a partial cross-sectional view illustrating a side in FIG. 12A.
Figure 12C:
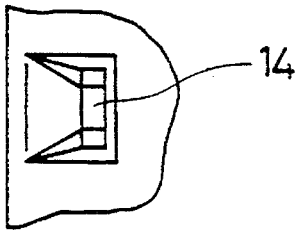
FIG. 12C is a partial top view illustrating the projection in FIG. 12B.
Figure 13A:
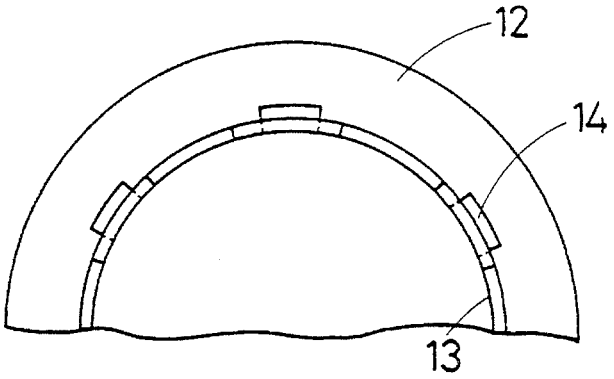
FIG. 13A is a partial side plan view illustrating a side of a pipe tip end according to the modified embodiment.
Figure 13B:
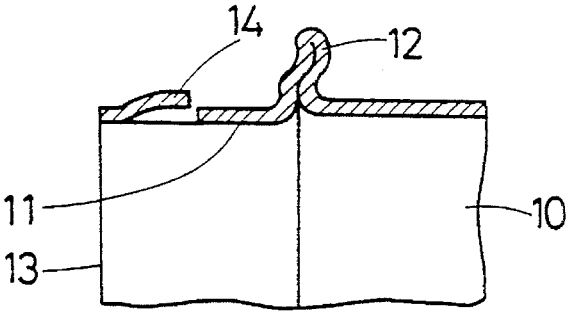
FIG. 13B is a partial cross-sectional view illustrating a side in FIG. 13A.
Figure 13C:
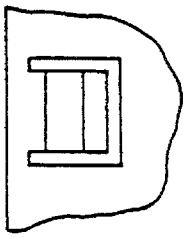
FIG. 13C is a partial top view illustrating the projection in FIG. 13B.

In this embodiment, the projection 14 of the pipe 10 is formed by cold chasing as shown in FIGS. 6A and 6B. However, the projection 14 may be formed by cutting and bending as illustrated in FIGS. 5A and 5B or by half-cutting as illustrated in FIGS. 7A and 7B. Furthermore, although the number of projections 14 is six in this embodiment, any number except one is acceptable. Other modifications are also shown in FIGS. 12A, 12B, 12C, 13A, 13B and 13C. The projection 14 is formed as V-shape, as illustrated in FIGS. 12A, 12B and 12C in order to improve the strength and rigidity thereof. The projection 14, may be formed to stamp around thereof and then folded so as to reduce a force for inserting as illustrated in FIGS. 13A, 13B and 13C.

Figure 4:
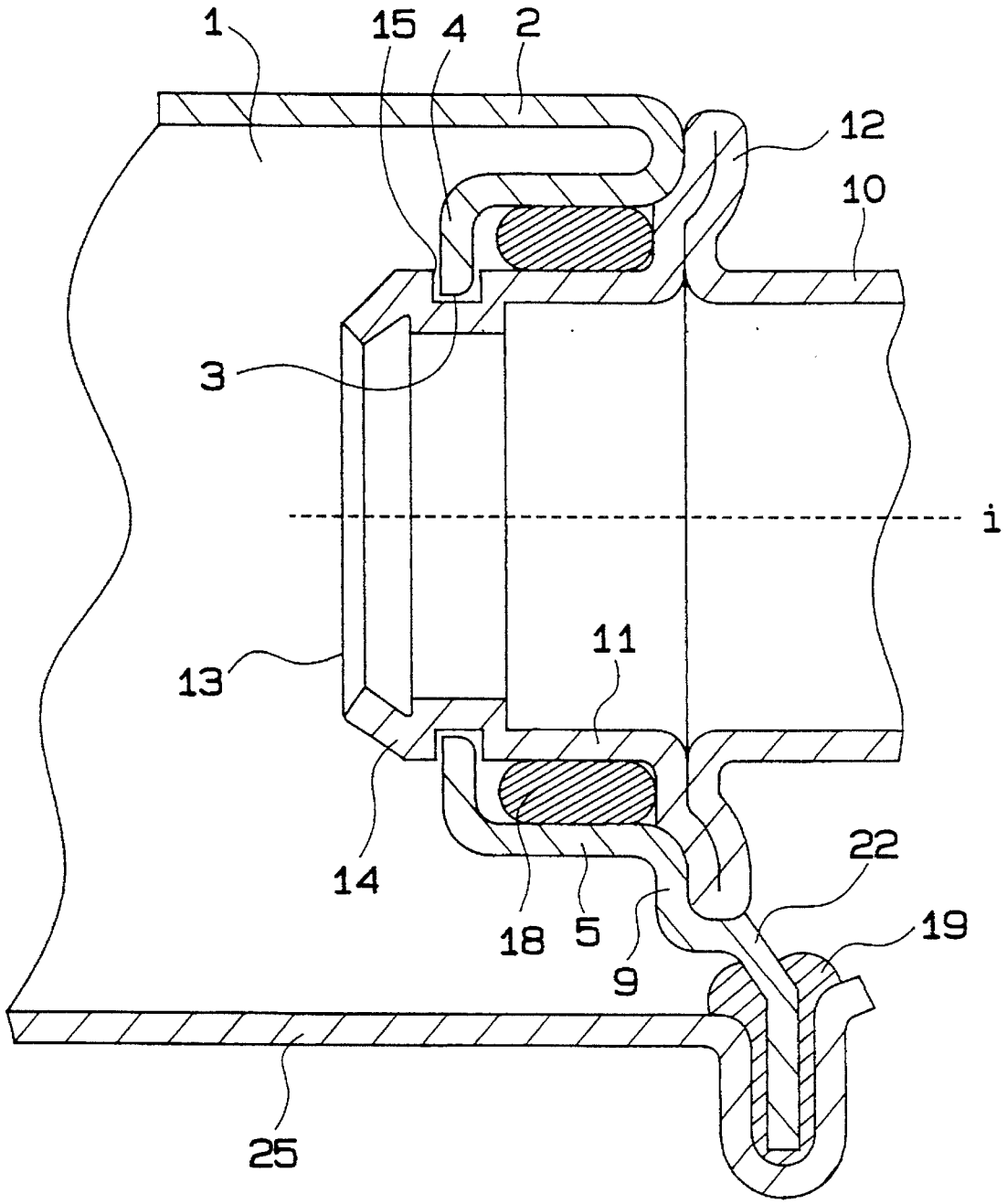
FIG. 4 is a cross-sectional view illustrating part of an embodiment of a capsule connected to a pipe according to the present invention.
Figure 8B:
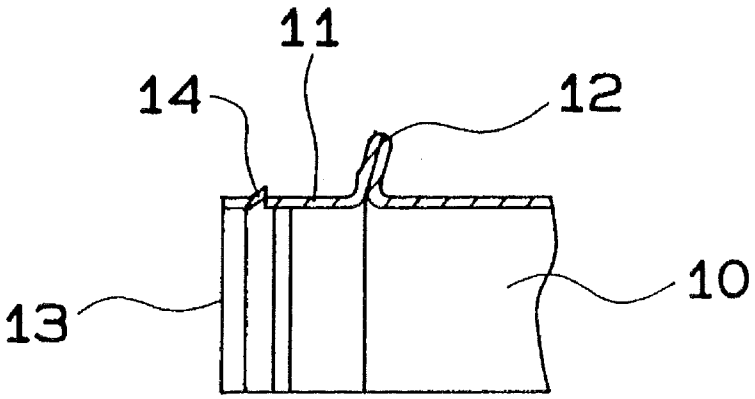
FIG. 8B is a partial cross-sectional view illustrating a side in FIG. 8A.
Figure 8A:
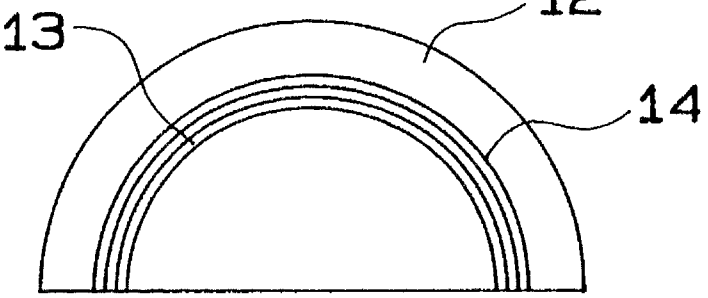
FIG. 8A is a partial side plan view illustrating a side of a pipe tip end according to the present invention.

In this embodiment, as illustrated in FIGS. 6A and 6B, projection 14 of pipe 10 is circumferentially formed in six positions. However, as illustrated in FIGS. 8A and 8B, projection 14 may be formed throughout the circumference for more powerful fitting of pipe 10 with capsule 2. Alternatively, as illustrated in FIG. 4, it may also be arranged that as well as projection 14, groove 15 is formed throughout the circumference of pipe 10 for receiving ring-shaped part 4. The reference number 19 in FIG. 4 denotes the brazing filler metal staying in a pool as a result of brazing.

Still it may also arranged that a slit is formed in several positions of tip end part 13 of the pipe to improve the flexibility of tip end part 13 in a direction vertical to axial direction i of pipe 10 for facilitating insertion of pipe 10.

Moreover, in this embodiment, although brass is used as a material for pipe 10 and capsule 2, any metal other than brass, such as aluminum, copper, iron and stainless steel, may be used or any elastic material such as resin may be used.

Still moreover, the present invention is applied to a heater core which is a heat exchanger for vehicles. However, the present invention is also applicable to any heat exchanger other than the heat core, e.g., radiator, oil cooler, intercooler, evaporator. Furthermore, while the present invention has been described in connection with fluid equipment, such as heat exchangers, the invention is not limited to such use. Rather, this invention may be used whenever a simplified connection between a pipe and a separate element is needed. That element need not be a piece of fluid equipment.

This invention has been described in connection with what are presently considered to be the most practical and preferred embodiments of the present invention. However, this invention is not intended to be limited .thereto. Rather, this invention is intended to cover all modifications and alternative arrangements included within the spirit and scope of the appended claims.

What is claimed is:

1. A pipe fitting mechanism for fitting a pipe to a second element, said mechanism comprising:

a side wall having a plate surface and having a fitting hole formed therein;

a pipe for inserting into said hole, said pipe having a thin wall of uniform thickness;

wherein said side wall includes a cylindrical member projecting inwardly relative to said plate surface and having a tip end, said cylindrical member projecting at approximately a right angle to said plate surface, a ring-shaped part formed on an inner peripheral side of said tip end, said ring-shaped part being approximately parallel to said plate surface, with said pipe fitting hole being formed at a central portion of said ring-shaped part;

wherein said pipe includes a flange part projecting radially outwardly thereof, said flange part being plastically formed by projecting and folding said thin wall, and wherein said pipe includes projections formed by chasing proximate a tip thereof to be inserted into said pipe fitting hole, a groove being defined between said flange part and said projections;

wherein said pipe and said side wall are locked to each other at two positions, one of said positions being between said projections and said ring-shaped part, said ring-shaped part being engaged with said groove, and the other position being between said flange part and said plate surface; and wherein a sealing material is sandwiched between an outer peripheral part of a section of said pipe, said ring-shaped part, said cylindrical member, and said flange part.

2. The pipe fitting mechanism according to claim 1, wherein a contact length between said ring-shaped part and said tip is shorter than a thickness of said side wall.

3. A heat exchanger comprising:

a panel material shaped into a box with one side open;

a pipe fixed to said panel material, said pipe having a thin wall of uniform thickness;

at least one section of a tank formed of said panel material and a seat panel joined to the open surface of said panel material; and a plurality of heat exchanging tubes with one end thereof being connected to said seat panel of said tank for communicating with said tank;

wherein said panel material includes a cylindrical part projecting inward relative to a panel surface of said panel material at approximately a right angle to said panel surface, a ring-shaped part formed on an inner peripheral side of a tip end part of said cylindrical part and being approximately parallel to said panel surface, and pipe fitting hole formed at a central part of said ring-shaped part for fitting said pipe;

wherein said pipe includes a flange part projecting generally radially outward thereof, said flange part being plastically formed by projecting and folding said thin wall, and a projecting portion comprising at least one projection defined adjacent a tip end of said pipe to be inserted into said pipe fitting hole;

wherein said pipe and said panel material are locked to each other by contact at two interface positions between said projection portion and said ring-shaped part and between said flange part and said panel surface for preventing the displacement in an axial direction of said pipe; and wherein an annular sealing material is sandwiched between said outer peripheral surface of said pipe, said ring-shaped part, said cylindrical part, and flange part.

4. A heat exchanger comprising:

a panel material shaped into a box with one side open;

a pipe fixed to said panel material, said pipe having a thin wall of uniform thickness;

at least one section of a tank formed of said panel material and a seat panel joined to the open surface of said panel material; and a plurality of heat exchanging tubes with one end thereof being connected to said seat panel of said tank for communicating with said tank;

wherein said panel material includes a cylindrical part projecting inward relative to a panel surface of said panel material at approximately a right angle to said panel surface, a ring-shaped part formed on an inner peripheral side of a tip end part of said cylindrical part and being approximately parallel to said panel surface, and a pipe fitting hole formed at a central part of said ring-shaped part for fitting said pipe;

wherein said pipe includes a flange part projecting generally radially outward thereof, said flange part being plastically formed by projecting and folding said thin wall, and a plurality of projections disposed adjacent a tip end of said outer peripheral surface for insertion into said pipe fitting hole;

wherein said ring-shaped part includes a plurality of notched parts disposed on an inner peripheral side thereof for fitting with said plurality of projections, and a plurality of holding concave parts for holding said pipe while maintaining contact with said projections;

wherein said pipe and said panel material are locked to each other with contact at two positions, one position being between said projections and said holding concave parts and the other position being between said flange part and said panel surface for preventing displacement in an axial direction of said pipe; and wherein an annular sealing material is sandwiched between said outer peripheral surface of said pipe, said ring-shaped part, said cylindrical part, and flange part.

5. A connection between a pipe and a separate element, said connection comprising:

cylindrical part projecting inward from an outer surface of said separate element and a ring-shaped member formed at an inner end of said inward projecting cylindrical part;

said pipe having a thin wall of uniform thickness;

a flange projecting outward of said pipe, said flange being plastically formed by projecting and folding said thin wall;

projections formed adjacent a tip end of said pipe;

receiving elements formed in said separate element for receiving and interacting with said projections;

wherein said separate element locks to said pipe by contact between an outer peripheral surface of said pipe and said ring-shaped member, and between said outer surface of said separate element and said flange;

wherein a sealing member is disposed in an annular hole defined by said outer peripheral wall, said flange, said cylindrical part, and said ring-shaped member.

6. A connection as claimed in claim 5, wherein said inward projecting cylindrical part in substantially perpendicular to said outer surface.

7. A connection as claimed in claim 6, wherein said ring-shaped member is substantially perpendicular to said inward projecting cylindrical part.

8. A connection as claimed in claim 5, wherein said flange is substantially perpendicular to said inward projecting cylindrical part after said pipe is connected to said separate element.

9. The heat exchanger of claim 3, wherein said at least one projection is formed by chasing.

10. The heat exchanger of claim 4, wherein said projections are formed by chasing.

11. The connection of claim 5, wherein said projections are formed by chasing.

12. The heat exchanger of claim 3, wherein a groove part is defined between said projection portion and said flange part, and said ring-shaped part engages said groove part.

13. The heat exchanger of claim 4, wherein a groove part is defined between said projections and said flange part, and said ring-shaped part engages said groove part.

14. The connection of claim 5, wherein a groove is defined between said projections and said flange and said separate element locks to said pipe by contact between said ring-shaped member and said groove.

* * * * *